United States Patent [19]

Eckels

[11] Patent Number: 4,762,288

[45] Date of Patent: Aug. 9, 1988

[54] HOLDER FOR ROLLED PRODUCTS AND THE LIKE

[76] Inventor: Robert E. Eckels, 49 S. Lookout Mountain Rd., Golden, Colo. 80401

[21] Appl. No.: 28,120

[22] Filed: Mar. 19, 1987

[51] Int. Cl.[4] ..... B65H 19/00

[52] U.S. Cl. ..... 242/55.2; 242/55.54

[58] Field of Search ..... 242/55.2, 55.42, 55.53, 242/55.54, 68, 68.4; 312/39–41

[56] References Cited

U.S. PATENT DOCUMENTS

| | | | |
|---|---|---|---|
| 2,673,693 | 3/1954 | Gray | 242/55.2 |
| 3,088,686 | 5/1963 | Curry | 242/55.2 |
| 3,623,676 | 11/1971 | Eckels | 242/55.53 |
| 4,033,455 | 7/1977 | Robison | 206/408 X |
| 4,097,002 | 6/1978 | Krueger | 242/55.2 |
| 4,664,332 | 5/1987 | Barazone | 242/68.4 X |

*Primary Examiner*—David Werner

*Attorney, Agent, or Firm*—James E. Pittenger

[57] ABSTRACT

An improved holder for dispensing rolled products includes a U-shaped bracket having a base member for attachment to a vertical support surface and outwardly extending support members having an aligned conical shaped support shaft on the bottom member while the top member has a downwardly extending retainer shaft. The top shaft retains the roll in a vertical position while the bottom shaft supports the roll and includes surfaces and edges to provide a desired coefficient of friction to the retained roll to permit controlled dispensing from the roll. The bottom support shaft can also have an outwardly extending edge upon which the roll rests to add additional friction during the dispensing operation. Various configurations and surface treatment is provided for the various support shafts and retaining shafts. A separate embodiment of the holder shows the base member arranged in two telescoping sections wherein the two sections can be slidably moved with respect to each other to adjust the opening distance between the support and retainer shafts to accommodate various sizes of rolled products.

14 Claims, 2 Drawing Sheets

HOLDER FOR ROLLED PRODUCTS AND THE LIKE

BACKGROUND OF THE INVENTION

This invention is directed to an improved device for dispensing rolled products. It is more specifically directed to a mounted bracket which holds rolled products in a vertical position and applies friction to the roll to provide controlled dispensing.

Holders for bathroom tissue and other paper products generally have an extended shaft which is loosely positioned within the tube of the roll on which the product is wound. The shaft holding the rolled product is usually mounted either in the horizontal or the vertical position. In the prior art most of these devices make no attempt to prevent the excess dispensing of the rolled product at the time that the product is intended to be used. In other words a substantial pull on the end of the roll causes the roll to turn vigorously dispensing far more product than is intended or needed. This is due to the fact that there is no restraint or friction applied to the roll which allows the roll to rotate freely. As a result the product will unwind rapidly from the roll requiring the user to physically stop the roll from turning.

The applicant's prior art patent U.S. Pat. No. 3,623,676 made an attempt to correct this problem by mounting a roll of bathroom tissue in a vertical position so that the end of the roll will ride smoothly on a bottom-centering core. With the position of the core and the fact that the weight of the roll held the edge of the center tube against the core, a sliding friction is produced. As a result the problem encountered with dispensing excess tissue is diminished. However, it was found that this device did not eliminate all of the problems encountered with this type of dispenser. It was found that by pulling quickly or with too much force the tube was caused to ride up on the the center core pulling the tube off of the holding bracket. In addition, it was found that it was difficult to provide the correct friction on the tube to control the actual dispensing of the product. Thus, the prior patent eliminated some of the problems but failed to solve all of them.

INFORMATION DISCLOSURE STATEMENT

The following statement is provided in order to comply with the applicant's required duty to disclose all pertinent information which would be material to the examination of this application.

The Eckels patent (U.S. Pat. No. 3,623,676) discloses a vertical roll holder for bathroom tissue or other types of products which discloses a downward existing centering tab as well as a curved center core arrangement provided on the bottom of the mounting bracket. This device was primarily intended to be recessed into a wall or a cabinet to minimize the space required by the bracket and the product being dispensed. This patent primarilly discloses a center core support which is a smooth surfaced, flared or curved shape which is small enough to allow the tube holding the wound paper product to rest over the centering core. This device was merely intended to hold the product in the vertical position and provide some stabilizing drag to the tube to prevent free-wheeling of the tube during the dispensing operation.

SUMMARY OF THE INVENTION

The present invention is directed to an improved holder for rolled products which is very simple to load and unload and which maintains an improved friction grip on the tube of the rolled product to prevent accidental unwinding when a portion of the product is removed or pulled from the roll. Throughout this application when reference is made to a rolled product it is understood to apply to any type of product which is rolled or wound on a hollow core or tube. Examples of this type of product would be toilet tissue, paper towels, wrapping paper, twine, aluminum foil, etc.

The holder includes a U-shaped bracket which is vertically mounted on a wall, cabinet or suitable support surface. The outwardly extending arms or members of the bracket include a pair of vertically aligned stubs or shafts. The upper shaft is longer or at least equal to the length of the bottom shaft. The distance between the two shafts is less than the product which is intended to be used with the holder. The upper shaft can be an elongated member which can have a circular or rectangular cross section. The length of this shaft must be sufficient to allow the rolled product to be inserted over the downwardly extending member and still have enough distance provided between the upper and lower shafts so that the bottom of the tube will clear the bottom shaft and then slide downwardly and rest on that shaft. The bottom support shaft can be provided as a plurality of intersecting thin planar members which have a tapered base configuration and a vertical upwardly extending central projection. These elements form an equal-sided X configuration with the center core or tube of the rolled product contacting the tapered portion of the members making up the lower shaft.

A number of flat, thin members can make up the lower shaft configuration and each edge of the relatively thin members provides an increased frictional element to the edge of the internal tube of the product to provide desired frictional control.

In addition, an elongated rib or extension can be positioned between the shaft and the base member of the bracket. The rib can have sufficient height to support the edge of the rolled product at the same time that it is guided by the bottom shaft so as to provide additional friction to the roll during the dispensing process.

Various other configurations for the lower shaft can be provided. The overall outer configuration of the individual members making up the shaft can have various outer profiles which form the upwardly extending projection. Thus, the overall outer configuration can be of a circular or rectangular nature with a tapered lower section. As an alternative the outer surface of the shaft may have a number of equally spaced ridges around the outside edge. In another configuration, a rough or high friction surface can be provided on a knob-like projection. In another, the outer surface instead of being fairly rough can be fluted similar to the arrangement as provided on a pyramid.

The upper shaft can have a varied thickness as well as width and can have side longitudinal grooves which provide a number of thin edges to control the overall positioning of the upper end of the tube.

In a further embodiment it is possible to provide telescoping section for the base mounting portion of the bracket whereby the two ends of the brackets can be moved closer or further away to accommodate rolled products having various lengths. In this way the upper and lower shafts can be of a set or predetermined length with the space between the shafts varied to fit the desired product merely by loosening or repositioning the mounting screws and moving the ends with respect to each other. As an alternative, a slidable pin or elongated member can be inserted through a series of apertures provided in the side of one of the sections to hold the section at the desired dimension.

Other features and advantages of the present invention will become apparent from the following detailed description of the invention when it is considered in conjuction with the accompanying drawings.

DETAILED DESCRIPTION OF THE INVENTION

Figure 1:
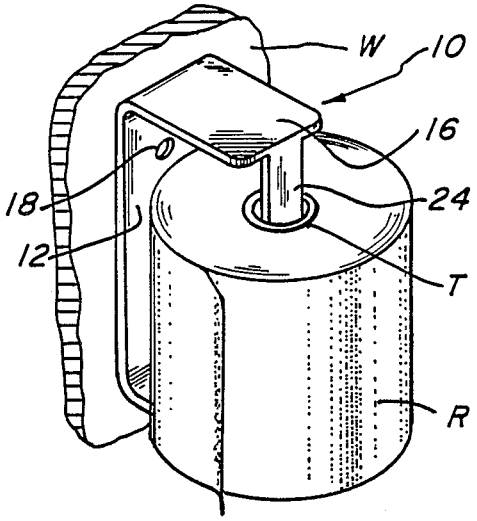
FIG. 1 shows a pictorial perspective view of the improved holder according to the present invention with a rolled paper product in position for dispensing.
Figure 2:
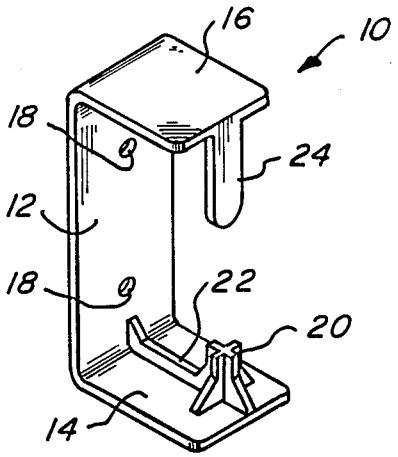
FIG. 2 is a perspective view of the same holder as shown in FIG. 1 without the product in position.
Figure 3:
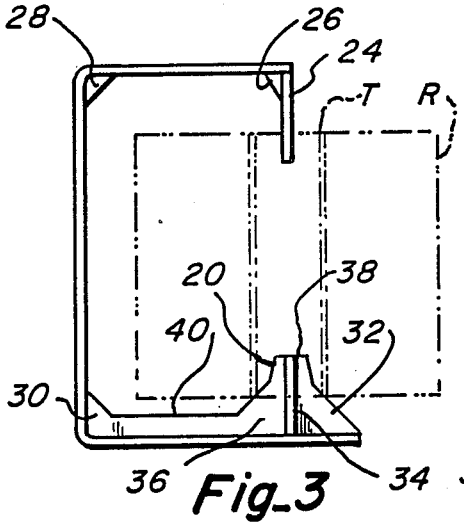
FIG. 3 shows a side elevation view of the holder shown in FIG. 2 with the paper product roll shown in dotted lines.

Turning now more specifically to FIGS. 1 and 2, the roll holder 10 is comprised of the base member 12, bottom support member 14 and top support member 16. The base member 12 is mounted in a generally vertical position to a support surface W such as a wall or cabinet by suitable fasteners inserted through the mounting holes 18.

A stub or support shaft 20 along with support edge 22 is mounted on the upper surface of the bottom member 14. In a similar fashion an elongated guide or retainer shaft 24 is mounted on the undersurface of upper member 16. In some cases the upper and lower shafts are axially aligned with respect to each other. The entire bracket including the base member 12 and top and bottom members 14, 16 are fabricated from molded plastics such as polystyrene or polyurethane and in order to provide additional strength at the joints, gussets 26, 28 and 30 can be provided.

In use the roll R which can be any type of rolled product such as toilet tissue, papers towels, twine, or the like can be mounted on the support shaft 20 and retainer shaft 24 by merely inserting the hollow tube T upon which the product is wound first over the upper shaft 24 until the bottom of the tube T clears the bottom support shaft 20 and the roll is then lowered until it is supported and resting on the lower support shaft 20.

Figure 4:
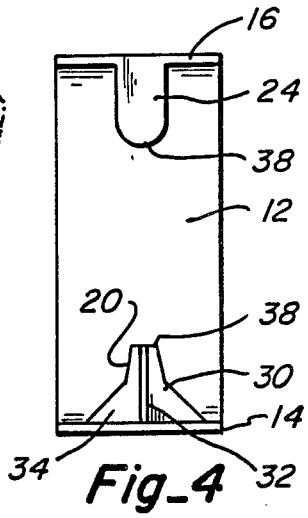
FIG. 4 is a front elevation view.

The support shaft 20 is made from a number of thin, flat elements which have relatively sharp outer edges. These elements 30, 32, 34 and 36 have an outer surface or profile configuration which provides the desired support surfaces for the tube T. The side view of the elements 30, 34 which are shown in FIG. 4 discloses a double conical configuration wherein the lower portion has a shallower angle than the sides of the upper portion. The top 28 of the shaft 20 can be truncated if desired, or left pointed without materially effecting the function of the shaft. All four elements have generally the same outer edge contour to provide a symmetrical support surface for the tube T.

In addition, a support edge 40 provided on the rib 22 can be provided whereby the edge 40 will be elevated high enough to cause the roll R to rest slightly on the surface of the edge 40. In this way, the surface 40 will provide a frictional drag along half of the edge of the roll R and provide additional friction in addition to the edges of the shaft 20.

Figure 5:
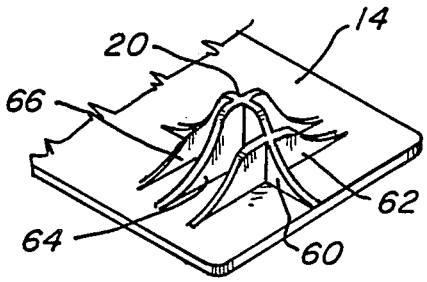
FIG. 5 is a perspective view of one embodiment of the bottom shaft.
Figure 6:
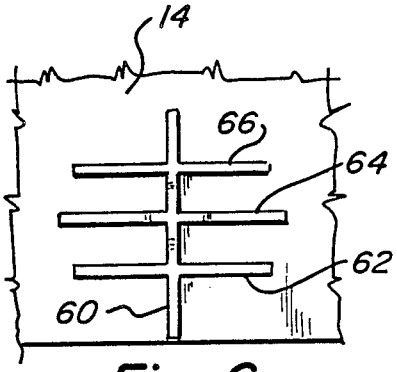
FIG. 6 is a top plan view of the bottom shaft shown in FIG. 5.

FIGS. 5 and 6 show another embodiment of the bottom or support shaft 20 wherein individual thin, planar support members 60, 62, 64 and 66 are provided with the members 62, 64, and 66 positioned at right angles to the cross member 60 and the support member 14. The outer edges of these members have a tapered or curved surface which produce a rounded knob effect for the shaft 20. This flowing configuration is different than the conical configuration which was provided in the prior embodiment. Again, friction is appiled to the tube T of the rolled product R along the outer edges to provide a desired frictional restraint to the rotation of the roll. By rounding or sharpening the edges of the members and possibly varying the edge configuration on one, some or all of the members the desired friction can be obtained.

Figure 10:
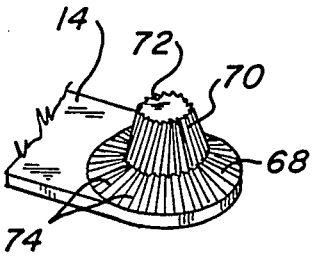
FIG. 10 is a perspective view of another embodiment of the bottom shaft.
Figure 11:
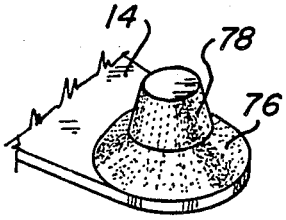
FIG. 11 is a perspective view of another embodiment of the bottom shaft.
Figure 12:
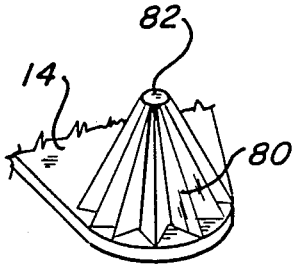
FIG. 12 is a perspective view of another embodiment of the bottom shaft.

FIGS. 10, 11 and 12 show further embodiments that can be provided for the support shaft 20. In FIG. 10 a relatively flat flange 68 and upwardly extending conical center section 70 ends in a flat truncated surface 72. The outer surface of the flange and conical portion includes a number of raised ridges 74 arranged around the entire outside surface of the shaft. The embodiment shown in FIG. 11 essentially has the same configuration as previously described with a sandpaper type or roughened outer surface to provide frictional control of the tube T. FIG. 12 shows a similar embodiment having a continuous conical outer configuration 80 ending in a truncated or flat surface 82. The outer surface of the cone 80 is formed in a number of radial flutes or ridges 84 which are spaced around the entire perimeter of the cone 80. This embodiment provides a number of sharp edges equally spaced or varied around the entire perimeter of the cone to apply pressure on the inside edge of the tube to create the frictional drag that is desired as the roll is unwound.

Figure 7:
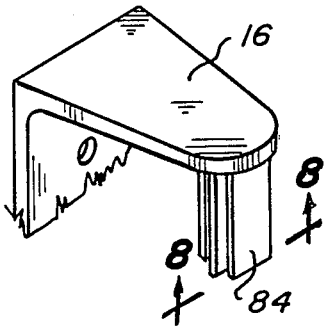
FIG. 7 is a partial perspective view of another embodiment of the top shaft.
Figure 8:
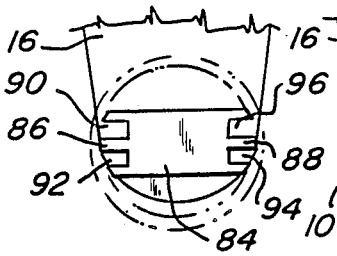
FIG. 8 is a cross sectional view taken along lines 8—8 of FIG. 7.

FIGS. 7 and 8 show a different embodiment for the vertical shaft 84 which takes the place of the previously described top or retainer shaft 24. In this arrangement the actual thickness of the shaft 84 is approximately one half of the width of the shaft. In the present embodiment the outer edges 86, 88 are rounded so that they essentially have less dimension than the inside diameter of the standard cardboard tube T upon which the paper product is wound. Vertical elongated grooves 90, 92 are provided along the edge 86 as well as vertical grooves 94, 96 which are provided along the edge 88. The vertical grooves divide up the respective edges into ridges wherein the edge along each ridge provides a friction element to produce drag between the shaft and the tube.

Figure 9:
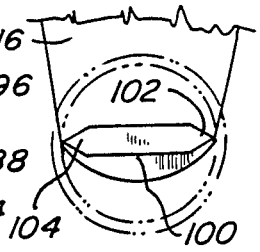
FIG. 9 is a cross sectional view of a top shaft showing another embodiment.

FIG. 9 shows another embodiment of the retainer shaft 100 wherein the thickness is considerably less than that previously described but the ends are beveled to form relatively sharp edges 102, 104. The distance across the edges 102, 104 is less than the internal diameter of the standard tube T. The sharpened edge on each side of the shaft 100 provides a centering effect as well as a frictional element.

Figure 13:
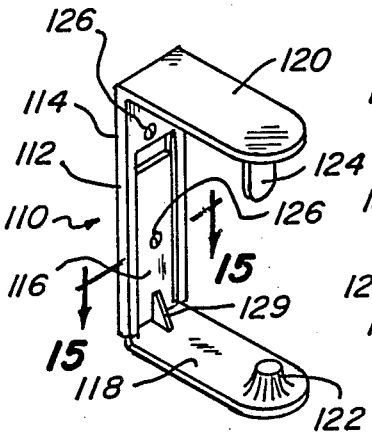
FIG. 13 is a perspective view of a holder according to the present invention showing a telescoping base configuration.
Figure 14:
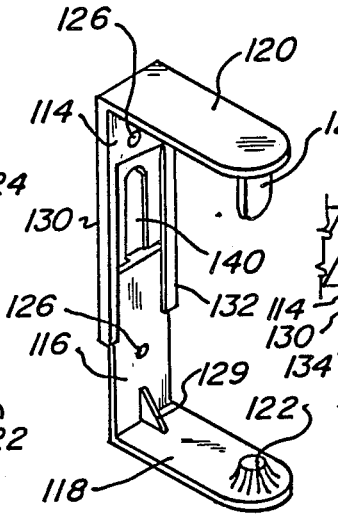
FIG. 14 is a perspective view showing the telescoping sections extended.
Figure 15:
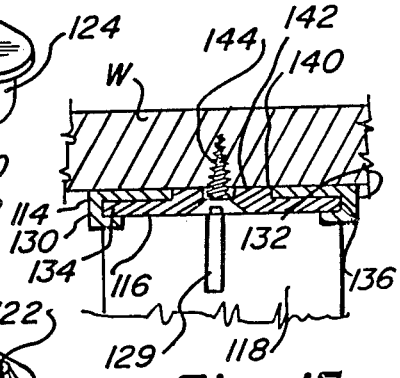
FIG. 15 is a partial cross sectional view taken along lines 15—15 of FIG. 13 showing details of the telescoping configuration.

One of the major problems in the prior art with a roll holder is the fact that the holder can only be used for one type of rolled product. In FIGS. 13–15 is shown a telescoping type of roll holder 110 wherein the base member 112 is formed as telescoping upper and lower slidable sections 114, 116. Lower or bottom support member 118 is arranged to extend substantially perpendicular from the slidable base section 116. By the same token top support member 120 is arranged usually perpendicular to the upper slidable base section 114. Bottom support shaft 122 and top retainer shaft 124 are mounted on the outwardly extending members 118, 120, respectively.

Upper base section 114 is bifurcated into downwardly extending legs 130, 132 with the inside surface of each of these legs having an elongated slotted groove 134, 136, respectively. An open central slot 140 extends between the downwardly extending legs 130, 132. The lower base section 116 has a width which is designed to slidably fit within the slotted grooves 134, 136 with an elongated raised central portion 142 provided on the back side of the section 116 so as to slidably fit within the slot 140. Thus, the base sections 114 and 116 can slidably interfit so that the distance between the support members 118, 120 can be adjusted within a considerable latitude.

In most cases the retainer shaft 124 will be at least longer than the support shaft 122 and in most cases will be approximately 1 times the length of the lower support shaft. To properly position the base members 114, 116 and properly space the ends of the shafts 122, 124 the intended rolled product is first slipped upwardly over the top retainer shaft 124 until the upper edge contacts the under surface of the support member 120. The bottom support member 118 is then raised or moved towards the upper support member until the bottom edge of the roll can be tilted outwardly and easily installed or removed from the bracket past the support shaft. At this point fasteners such as screws 144 are inserted through the mounting holes 126 provided in each of the base sections 114, 116 and secured to the support surface. Once the fasteners 144 are securely anchored, the relative position of the sections 114, 116 is fixedly established with the shafts 122, 124 properly spaced. In this way a single bracket according to the present invention can be utilized for a number of different rolled products with the outward dimension of the support members 118, 120 being established to accommodate most of the rolled products available. With a wide ranging diameter taper provided on the lower support shaft 122 all of the different types of products such as paper towels, aluminum foil, twine or toilet tissue can be accommodated on the same holder bracket as described.

The roll holder as provided in the present invention can be fabricated from any suitable material such as molded plastics having sufficient rigidity and resilience. In addition, the bracket can be formed from metal such as aluminum, steel, brass, stainless steel or any other suitable material such as ceramics which will provide the necessary strength and rigidity.

While an improved roll holder has been shown and described in detail in this application, it is to be understood that this invention is not to be limited to the exact form disclosed and changes in detail and construction of the invention may be made without departing from the spirit thereof.

What is claimed is:

1. An improved holder for dispensing products which are wound on a hollow center support tube, said products being dispensed by being unwound from the roll formed on said tube, the holder comprising:

(a) a U-shaped bracket having an elongated base member and a top and bottom outwardly extending support members mounted on one side of said base member, said base member being adapted to be mounted in a generally vertical position on an upright support surface;

(b) a support shaft means attached to the upper surface of said bottom support member, said support shaft having at least an upper portion having a diameter which is less than the inside diameter of said hollow tube, said support shaft means further having a tapered conical outer configuration, the upper portion of said support shaft means being a first tapered section and the lower portion of the shaft means having a second tapered section, the angle between the bottom support member and the second tapered section being less than the angle of the first tapered section, the major diameter of the second tapered conical section being larger than the inside diameter of said tube whereby the tube will be supported on the outer surface of the support shaft means at a point above the major diameter whereby friction will be applied to the edges of the hollow tube to control the dispensing of the product and prevent excess product from being dispensed; and (c) a retainer shaft means attached to the undersurface of the top support member, said retainer and support shafts being axially aligned.

2. An improved holder as defined in claim 1 wherein reinforcing gussets are arranged at the intersection of the base member and said top and bottom support members so as to strengthen the overall bracket structure.

3. An improved holder as defined in claim 1 wherein the outer surfaces of the first and second tapered sections of the support shaft means has a number of radially positioned ridges spaced around the circumference so that the ridges will provide controlled friction to the edge of the hollow product tube.

4. An improved holder as defined in claim 1 wherein the outer surfaces of the first and second tapered sections of said support shaft means has a roughened surface around the entire circumference which will provide a controlled friction to the edge of said product tube.

5. An improved holder as defined in claim 1 wherein the support shaft means is formed as a plurality of vertically arranged thin, planar members with one of said members being arranged generally perpendicular to the bottom support member of said bracket, said members when taken together having their outside edges form the double taper configuration of the support shaft means and each of the members having square outer edges which will apply controlled friction to the edge of the product tube.

6. An improved holder as defined in claim 1 wherein said bottom support member is arranged substantially perpendicular to said base member, said support member having an elongated longitudinal ridge extending along the upper surface of said bottom support member and having sufficient height to contact the outer edge of the product or tube supported on said support shaft means whereby additional frictional control is applied to the product during dispensing.

7. An improved holder as defined in claim 1 wherein said retainer shaft means is a flat, thin downwardly extending projection which has a rounded end, the width of said projection being slightly less than the inside diameter of said tube.

8. An improved holder as defined in claim 1 wherein said retainer shaft means is a downwardly exending projection which has a width which is slightly less than the inside diameter of said tube and the side edges of said projection are formed as a sharp edge which will contact the inside surfaces of said tube to aid in holding the tube in the bracket during dispensing.

9. An improved holder as defined in claim 1 wherein said retainer shaft means has a thickness which is approximately one-half of its width and a plurality of longitudinal grooves are provided along the entire outer edges of said shaft means, the outer surfaces of the shaft means being curved so that the shaft means will fit within the end of the hollow product tube with the edges of the shaft means contacting the inside surface of the tube to apply additional friction and control to the tube.

10. An improved holder as defined in claim 1 wherein said base means has an upper and lower section which are arranged in a slidable, telescoping configuration whereby the distance between said bottom and top support members can be varied to accommodate various sized product rolls.

11. An improved holder as defined in claim 10 wherein said upper base section has bifurcated leg sections wherein the inside surfaces of each leg has a longitudinal channel, and said lower base section is sized to fit within the channels of said upper section which will allow the lower section to slide with respect to said upper section to allow adjustment in the overall length of said base member.

12. An improved holder as defined in claim 11 wherein a mounting hole is provided in each of the upper and lower base section wherein when the base member is attached to the support surface the sections will be held in fixed relative position.

13. An improved holder as defined in claim 10 wherein an elongated member can be inserted between said telescoping upper and lower base sections to fixedly position said sections with respect to each other.

14. An improved holder for rolled products which will prevent excess product from being dispensed from the roll, said rolled products being wound on a hollow tube for support, the holder comprising:

(a) a U-shaped bracket having a base member and top and bottom outwardly extending support members arranged on one side of said base member, said base member being adapted to be mounted in a generally vertical position on a substantially upright support surface;

(b) a support shaft means attached to the upper surface of the bottom support member, said support shaft means having a tapered conical outer configuration, the upper portion of said tapered conical support shaft means having an upper portion having a first tapered section and a lower portion having a second tapered conical section, the angle between the bottom support member and the second section being less than the angle of the first section, the second tapered conical section having a major diameter which is larger than the inside diameter of said tube whereby the tube will be supported on the outer surface of the support shaft means at a point above the major diameter whereby friction will be applied to the edges of the hollow tube to control the dispensing of the product and prevent excess product from being dispensed, said support shaft means being formed by a plurality of thin members which are arranged perpendicular to the bottom support member and positioned with respect to each other to form the tapered conical shaft means; and (c) a retainer shaft means mounted to the undersurface of the top support member, said retainer and support shafts being axially aligned with respect to each other, said retainer shaft means being a generally thin flat member extending downwardly from the top support member and having a width which is slightly less than the inside diameter of said hollow tube and having a length which is sufficient to allow the product and tube to be inserted between said retainer shaft means and support shaft means for insertion of the product into the holder.

* * * * *